United States Patent [19]

Triolo

[11] 4,086,387

[45] Apr. 25, 1978

[54] HOT COMPRESSED FABRIC CONDITIONING PRODUCT

[76] Inventor: Rocco P. Triolo, 2512 Parke Lane, Broomall, Pa/ 19008

[21] Appl. No.: 720,269

[22] Filed: Sep. 3, 1976

[51] Int. Cl.[2] ..... B05D 5/00; B05D 3/12

[52] U.S. Cl. ..... 428/311; 427/244; 427/276; 427/366

[58] Field of Search ..... 427/243, 244, 365, 366, 427/369, 370, 390 B, 271, 275, 170, 278, 439, 434; 428/311; 118/60; 252/8.6

[56] References Cited

U.S. PATENT DOCUMENTS

| | | | |
|---|---|---|---|
| 2,622,995 | 12/1952 | Lippert et al. | 427/366 |
| 2,649,386 | 8/1953 | Snowman, Jr. | 427/278 X |
| 2,819,179 | 1/1958 | Barnard et al. | 427/278 |
| 3,442,692 | 5/1969 | Gaiser | 427/240 |
| 3,551,186 | 12/1970 | Martin et al. | 427/366 X |
| 3,632,396 | 4/1969 | Zamora | 252/8.6 X |
| 3,686,025 | 8/1972 | Morton | 428/219 |

FOREIGN PATENT DOCUMENTS

| | | | |
|---|---|---|---|
| 1,205,964 | 9/1970 | United Kingdom | 427/278 |

*Primary Examiner*—Morris Kaplan

[57] ABSTRACT

Heat activatable, fabric conditioning products comprising thick, absorbent substrates impregnated with fabric conditioning chemicals are suitable for use at elevated temperatures encountered in laundry dryers. Prior to being used, such products tend to be stiff and boardy because of the brittle, wax-like properties of the fabric softener chemicals at ambient temperature. The stiff-boardy properties have been substantially eliminated by temporarily compressing the thick impregnated substrate to less than 70% of its original thickness. However, substantial impregnate is lost as dust from the substrate during compression at ambient temperatures. When hot rollers are employed for compressing the impregnated substrate, the loss of chemical impregnated ingredients caused by the compression step is substantially reduced.

14 Claims, 1 Drawing Figure

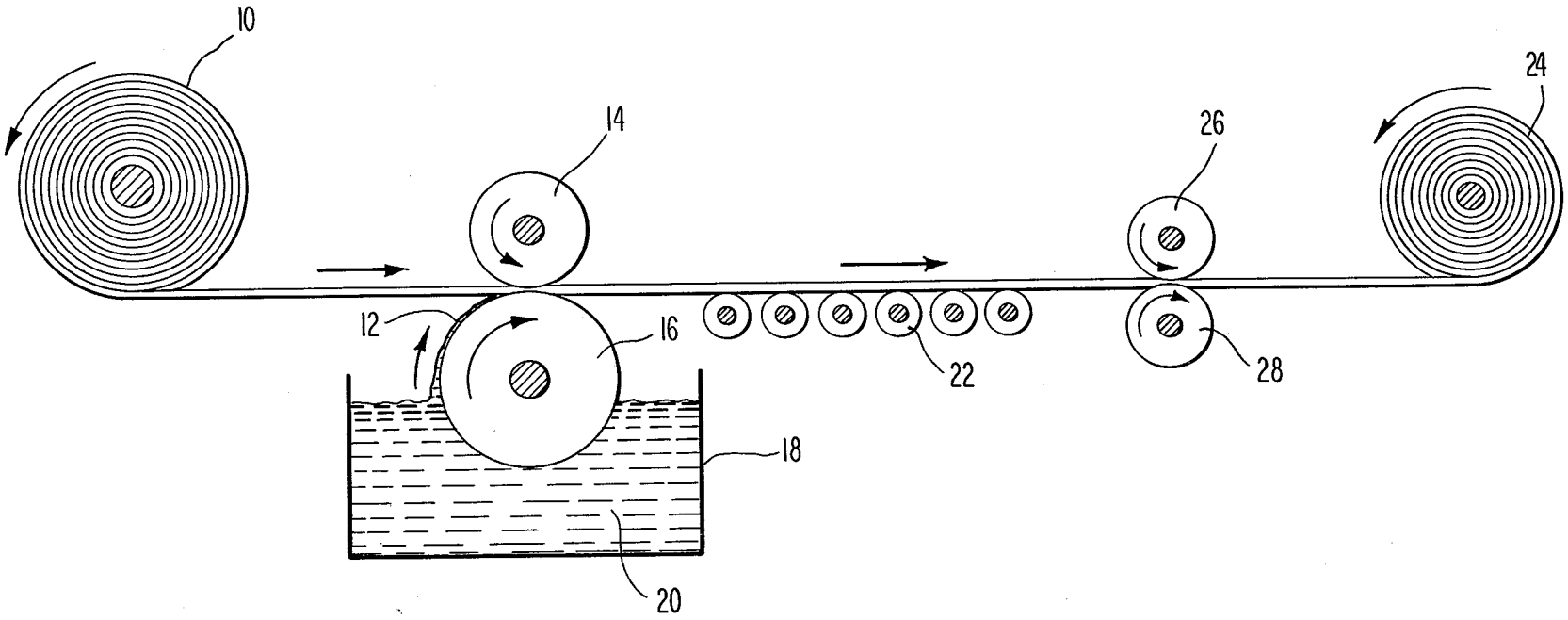
10
12
14
16
18
20
22
24
26
28

HOT COMPRESSED FABRIC CONDITIONING PRODUCT

BACKGROUND OF THE INVENTION

1. Field of the Invention

This invention relates to fabric conditioning products suitable for use at elevated temperatures encountered in laundry dryers. In particular the invention relates to improving a compressing step for eliminating the rigidity imparted to the substrate by the fabric softening agents.

2. Description of the Prior Art

Surface modification of fabrics, particularly cellulosic fabrics, to soften and impart properties such as antistatic, lubricating, bacteriostatic, mildew-proof and moth-proof properties has been accomplished by treating the fabrics with appropriate chemicals for modifying such properties. It is now common practice to treat various types of household apparel and fabrics such as wool, cotton, and synthetics such as polyesters or nylon, with one or more specialized conditioning agents for affecting the softness and other properties of the fabrics.

For various beneficial reasons, the practice has recently developed of softening and otherwise conditioning household apparel and fabrics during drying of the fabrics after laundering. Fabric conditioning products comprising sheet goods (substrate) coated or impregnated with a fabric-softening chemical and/or other specialized fabric conditioning chemicals have been commingled with damp laundry during the drying of the laundry at the elevated temperatures encountered in a typical household laundry dryer. The elevated temperatures encountered during drying releases the specialized fabric conditioning chemicals which are transferred to the commingled fabrics during drying.

Typical absorbent sheet goods employed as a substrate for heat-activated, fabric-softening products include flexible foam, felted, non-woven, air-lay and wet-lay fibrous sheets such as paper toweling, skrims, cloth, and air-lay webs composed of cellulosic or synthetic fibers of papermaking-length or longer. For example see U.S. Pat. No. 3,442,692 entitled METHOD OF CONDITIONING FABRICS.

Fabric-softening chemicals and other specialized chemicals for conditioning fabrics have been coated onto or impregnated into such absorbent substrates. Preferably, to avoid staining and other problems during drying, the conditioning chemicals have been impregnated into the absorbent substrate in combination with controlling the absorbent characteristics of the substrate. For example see U.S. Pat. No. 3,686,025 entitled TEXTILE SOFTENING AGENTS IMPREGNATED INTO ABSORBENT MATERIALS.

The fabric conditioning chemical is applied to the absorbent substrate in liquid form (a molten bath or a solution made with a solvent) and then solidified (by cooling or evaporating the solvent). The absorbent substrate with the solidified fabric conditioner impregnated into the substrate is stiff and boardy due to the solidified fabric conditioner even if the substrate was soft and flexible prior to being impregnated.

Previously it was discovered that temporarily compressing a thick, absorbent substrate having a solidified fabric conditioner chemical impregnated therein produces a softer, more flexible impregnated substrate. The compressing should reduce the thickness of the substrate to less than 70% of its original thickness. The substrate usually returns to substantially its original thickness shortly after the compressive forces are released. The process of compressing such impregnated substrates is disclosed in a U.S. Patent Application entitled IMPROVED FABRIC SOFTENER COMPOSITION, invented by Robert A. Volz and Robert E. Welsh, and assigned to Scott Paper Company, which process is improved by the present invention.

SUMMARY OF THE INVENTION

Employing hot rollers for compressing a thick, absorbent substrate impregnated with a solidified fabric softening chemical substantially reduces the loss of impregnated chemicals from the substrate while retaining the benefits imparted to the impregnated substrate by compressing it to less than 70% of its original thickness. Specifically, in the method of manufacturing a heat-activatable fabric conditioning product comprising impregnating an absorbent substrate having a thickness of at least 0.05 centimeters with a liquid fabric conditioner, solidifying the fabric conditioner, and passing the absorbent substrate having the solidified fabric conditioner impregnated therein through a nip formed by two rollers having a gap between rollers preset to reduce the thickness of the absorbent substrate to about 70% or less of its original thickness as it passes through the nip, the improvement which comprises; maintaining the rollers at an elevated temperature equal to or greater than the initial melting point of the fabric conditioner impregnated in the substrate.

BRIEF DESCRIPTION OF THE DRAWING

The FIGURE of drawing schematically depicts the manufacture of a heat activatable, fabric conditioning product and the subsequent compressing of the product with hot rollers.

DETAILED DESCRIPTION OF THE INVENTION AND EMBODIMENT

Absorbent substrates suitable for use in the present invention should have a thickness of at least about 0.05 centimeters and substantial "free space" or "void volume". Examples of suitable substrates are absorbent sponges such as flexible foams, and non-woven fabrics such as multi-ply paper, heavy basis weight paper, felted fabrics and knitted or woven bulky fabrics.

The free space or void volume of substrates can be defined in terms of the absorbent capacity determined according to a standard test. A test for determining absorbent capacity of thick paper, foam or cloth substrates is U.S. Federal Specifications UU-T-595b modified as follows:

1. Tap water is used instead of distilled water;
2. The specimen is immersed for 30 seconds instead of 3 minutes;
3. Draining time is 15 seconds instead of 1 minute; and
4. The specimen is immediately weighted on a balance scale having a pan with turned-up edges.

Thick paper products (having a basis weight of greater than about 100 pounds per 3,000 sq. ft. and a thickness greater than about 1/16 inch) have an absorbent capacity value as determined by the above test of greater than about 6.0 and are suitable for use in the present invention.

Absorbent substrates impregnated with a heat-softenable, fabric-conditioning agent are well known and will be referred to hereinafter as "heat-activatable fabric conditioning product" and also as "impregnated substrate".

The substrate is usually in the form of a long, wide sheet having a thickness of at least about 0.05 centimeters and preferably a thickness of about 0.25 centimeters. The minimum thickness of the substrate is significant since impregnating the material with a liquid fabric conditioning agent that is subsequently solidified gives the substrate material a stiff, boardy character due to reinforcing of the substrate by the solidified fabric-conditioning agent. Very thin substrates would still be somewhat flexible. Accordingly, the function of the present invention is applicable to substrates having a significant thickness of at least about 0.15 centimeters.

The preferred substrate is flexible foam sheet material having a void volume of greater than about 80% (preferably greater than about 95%) and a thickness of greater than about 0.05 centimeters. A void volume of greater than about 80% correlates approximately with an absorbent capacity value as determined by the above test of greater than about 10. Preferred foam sheet material is flexible, polyether-based, polyurethane foam having a thickness of about 0.25 centimeters and a pore size in the range of from about 10 to about 100 pores per inch. While woven, nonwoven or knitted cloth fabrics are suitable, they are not preferred in practicing the present invention.

Handling, finishing and packaging of thick heat-activatable fabric conditioning products produces substantial quantities of dust caused by the breaking off of small particles of solidified fabric conditioning chemicals. Temporarily compressing the impregnated substrate to less than about 70% of its original thickness renders the product very soft and fabric-like to the feel as compared to the stiff, boardy properties of the product prior to being compressed.

Heat-activatable fabric conditioning products of the type softened by the present invention are produced by impregnating a suitable substrate with liquid fabric conditioning chemical followed by solidifying the chemical in the substrate. Impregnation is accomplished by contacting the substrate with the liquid fabric conditioner composition, squeezing the substrate and allowing the substrate to expand in the presence of the liquid. Preferably the fabric conditioner is liquified by being held at an elevated temperature above the melting point of the fabric conditioning composition. In addition solvents can be used to liquify the fabric conditioner chemicals or reduce its melting point range.

When the hot-melt technique is used, the impregnated substrate is cooled to solidify the melted fabric softener composition or the substrate. When a solvent system is employed, the solvent is evaporated sufficiently to solidify the fabric-softener composition.

After solidification of the fabric conditioner chemicals, the impregnated substrate is temporarily compressed to 70% or less of its original thickness. When the compressive forces are relieved, the resulting impregnated substrate is softer and more fabric-like to the feel. Significantly, a subtle color change occurred in the impregnated product.

Fabric conditioning chemicals and mixtures thereof suitable for use in heat-activatable fabric conditioning products are well known and disclosed in U.S. Pat. No. 3,442,692 issued to C. J. Gaiser on May 6, 1969, entitled METHOD OF CONDITIONING FABRICS at column 3, line 7 to column 4, line 24 which disclosure is incorporated herein by reference with respect to its teachings of suitable fabric conditioning chemical compositions. U.S. Pat. No. 3,632,396 issued on Jan. 4, 1972 entitled DRYER-ADDED FABRIC-SOFTENING COMPOSITION disclosed suitable heat-activatable fabric softening compositions at column 7, line 70 to column 12, line 73 which disclosure is also incorporated herein by reference with respect to its teachings of heat activatable fabric softening and conditioning chemicals. Suitable compositions are also disclosed in U.S. Pat. Nos. 3,686,025; 3,870,145 and 3,895,128. Usually, from about 2 to 10 ounces of active ingredients (fabric softener chemicals) are impregnated per square yard of substrate with about 4 oz. per square yard being preferred.

Heat-activatable fabric softening products and methods of producing such products with thick absorbent substrates are disclosed in U.S. Pat. No. 3,686,025 issued to D. R. Morton entitled TEXTILE SOFTENING AGENTS IMPREGNATED INTO ABSORBENT MATERIALS. The Morton patent discloses sponges, multi-ply paper and nonwoven cloth as suitable substrates. Suitable fabric conditioning compositions are disclosed in the Morton patent at column 5, line 51 to column 14, line 34 which disclosure is incorporate herein by reference. Products produced according to the teachings of the Morton patent with thick substrates can be rendered softer and more flexible when compressed according to the present invention.

The process of the present invention for compressing a heat-activatable fabric conditioning product can be best understood with reference to the drawing. The drawing shows a manufacturing process and the post compressing of the product with hot rollers to soften and reduce dusting (loss of solidified impregnant caused by pieces of impregnant breaking off during the compression step). Suitable absorbent substrate, 10, passes through the nip of mating rollers 14 and 16 where it is compressed in the presence of molten fabric conditioning composition, 12, which causes impregnation of the molten fabric conditioning composition into substrate 10. The molten fabric conditioning composition (composed of one or more heat-activatable fabric conditioning chemicals along with any other desired additives such as perfumes and solvents) is supplied to the nip by lower roller 16 which is partially immersed in a molten bath 20, contained in heated tank 18. The impregnated substrate expands as it leaves the nip of rollers 14 and 16 which completes the impregnating process. The impregnated product passes over rollers 22 where solidification of the impregnant occurs as the impregnated substrate cools to ambient temperatures. The substrate with the solidified fabric softener composition then passes through the nip of rollers 26 and 28. The gap between rollers 26 and 28 is preset for compressing the substrate to 70% or less of its original thickness. Rollers 26 and 28 are heated to a temperature equal to or above the initial melting point of the impregnant composition, 12. The substrate leaves the nip of heated compression rollers 26 and 28 and regains substantially all of its original thickness due to the release of the compressive forces. At this point the essential steps of the process have been performed and the heat-activatable fabric conditioning product, 24, is softer, more flexible and less subject to dusting or other handling and finishing problems.

The minimum temperature of the compression rollers is within at or the melting point range of the fabric conditioner impregnant. Since the impregnant is usually a mixture of ingredients, it does not have a precise melting point but exhibits melting point temperature range. Preferably, the temperature of the rollers is above the melting point range. For usual fabric conditioner mixtures containing normal additives such as perfumes, antistatic agents, solvents and the like, a temperature of 110° F is usually sufficient. Preferred is a temperature between 120° F and 180° F.

The preferred temperature for the rollers is also influenced by the speed of the impregnated substrate passing through the nip (line speed). The line speed equals the peripheral speed of the heated rollers. An increase in the line speed decreases the contact time for the impregnated substrate with the heated rollers. This is preferably compensated for by increasing the temperature of the heated rollers to a temperature substantially above the final melting point of the composition impregnated into the substrate.

In practicing the present invention, the compression of the heat-activatable fabric conditioning product should be sufficient to reduce the thickness of the product by 30% or more, however the duration of the compression or duration of the thickness reduction are not critical. For example, a foam substrate having a thickness of 0.5 centimeters should be compressed to a thickness of 0.35 centimeters or less in order to make the composition less brittle and reduce its dusting tendency during subsequent handling and finishing. After release of the compessive forces, most foam substrates regain substantially all of their original thickness within a few minutes. Whether or not the original thickness is completely regaining is not critical since the benefits imparted by the present invention are present even if the product does not regain all of its original thickness.

The following example demonstrates the process and the improved heat-activatable fabric conditioning product produced by the process. All proportions stated herein are by weight unless otherwise indicated.

EXAMPLE I

Five samples (A, B, I, II and III) of a fine cell (approximately 80 pores per inch), flexible, polyether based, polyurethane foam having a density of about 1.4 pounds per cubic foot and a thickness of about 0.085 inches were impregnated with a molten fabric softener composition comprising 84% by weight Varisoft® 137 and 15% by weight Veronic® 485 and 1% perfume. Each of the samples were compressed to less than 70% of its original thickness of 0.085 inches by passing the sheet of impregnated foam through a nip produced by two rollers having a gap between rollers of less than 70% of the substrate thickness. The rollers were maintained at a different surface temperature for each sample as reported in the table. After the impregnated foam passed through the rollers, the foam had substantially improved softness and fabric-like properties. The weight loss of coating due to the compressing of the impregnated foam was determined and reported in the table.

Each of the samples above were made with a light blue colored foam substrate. After impregnating with the fabric softener composition, the impregnated product had a color altered by the presence of the fabric softener composition. After being compressed, a subtle color change occurred giving the compressed portions of the resulting product a different color shade closer to the original light blue color of the foam substrate. The non-compressed portions (i.e., compressed less than 30%) retained a color tone altered by the fabric softener composition.

TABLE

| Sample | A | B | I | II | III |
|---|---|---|---|---|---|
| Compression roll temperature, ° F | 65 | 100 | 120 | 130 | 140 |
| Impregnant % of substrate | 245 | 261 | 254 | 210 | 238 |
| Oz./sq. yard | 3.7 | 3.9 | 3.8 | 3.2 | 3.6 |
| Impregnant Loss % | 27 | 25 | 17 | 12 | 12 |

Significance

Samples A and B support the observation that compressing the impregnated substrate at ambient temperature substantially reduces the amount of impregnant remaining in the substrate, often by as much as 40% of the initial weight of impregnant. Since the impregnant is lost from the substrate as very small particles, the phenomenon is known as dusting. Example I, II and III substantiates the fact that the present invention substantially reduces the dusting problem while still making the impregnated substrate softer, more flexible and having an improved color.

The "initial melting point of the fabric conditioning composition" as used herein means the temperature at which melting begins for the conditioning ingredient or mixture of ingredients containing the fabric softener chemical which has been impregnated into the absorbent substrate.

Varisoft® 137 is a dialkyl dimethyl quarternary fabric softening chemical obtainable from Ashland Chemical Company and is defined chemically as dihydrogenated-tallow dimethyl ammonium methyl sulfate having a melting point of 138° C to 142° C and a molecular weight of about 645.

Varonic® 485 is a nonionic fabric conditioning chemical obtainable from Ashland Chemical Company and is believed to be a nonionic modified glyceryl monostearate having a HLB value of about 8.4.

The blend of Varisoft 137 and Varonic 485 employed in Example I contains about 6% isopropanol has a melting point range of about 50° C to 60° C.

What is claimed is:

1. In the method of manufacturing a heat-activatable fabric conditioning product comprising impregnating an absorbent substrate having a thickness of at least 0.05 centimeters with at least about 2 ounces per square yard of absorbent substrate of a liquid fabric conditioner, solidifying the fabric conditioner and passing the absorbent substrate having the solidified fabric conditioner impregnated therein through a nip formed by two rollers having a gap between rollers preset to reduce the thickness of the absorbent substrate to about 70% or less than 70% of its original thickness as it passes through the nip, the improvement which comprises;

maintaining the rollers at an elevated temperature equal to or greater than the initial melting point of the fabric conditioner impregnated in the substrate.

2. The method of claim 1 wherein the absorbent substrate is a flexible polyurethane foam.

3. The method of claim 1 wherein the substrate is a flexible, polyether-based polyurethane foam having a cellular size in the range of from 10 pores per inch to 100 pores per inch and having a void volume of at least about 95%.

4. The method of claim 1 wherein the amount of fabric conditioner chemical impregnated into the absorbent substrate is from about 2 ounces per square yard of absorbent substrate to about 10 ounces per square yard.

5. The improved heat-activatable fabric conditioning product produced by the process of claim 1.

6. The improved heat-activatable fabric conditioning product produced by the process of claim 3.

7. In the method of manufacturing a heat-activatable fabric conditioning product comprising impregnating an absorbent substrate having a thickness of at least 0.15 centimeters with at least about 2 ounces per square yard of absorbent substrate of a liquid fabric conditioner, solidifying the fabric conditioner, and passing the absorbent substrate having the solidified fabric conditioner impregnated therein through a nip formed by two rollers having a gap between rollers preset to reduce the thickness of the absorbent substrate to about 70% or less than 70% of its original thickness as it passes through the nip, the improvement which comprises;

maintaining the rollers at an elevated temperature of at least about 110° F.

8. The method of claim 5 wherein the temperature is from 120° F to 180° F.

9. The method of claim 7 wherein a portion of the impregnated substrate is compressed by the rollers and a portion is not compressed by the rollers to produce a heat-activatable fabric conditioning product having two distinct color tones.

10. The method of claim 9 wherein the compressed portion comprises a printed pattern of predetermined regular shapes.

11. The method of claim 10 wherein the predetermined regular shapes are letters.

12. The method of claim 9 wherein the noncompressed portion comprises a predetermined regular pattern.

13. The method of claim 12 wherein the predetermined regular pattern is composed of letters.

14. The heat-activatable fabric conditioning product produced according to the method of claim 12.

* * * * *

UNITED STATES PATENT OFFICE

CERTIFICATE OF CORRECTION

Patent No. 4,086,387 Dated April 25, 1978

Inventor(s) Rocco P. Triolo

It is certified that error appears in the above-identified patent and that said Letters Patent are hereby corrected as shown below:

On the front page, the designation of Assignee was omitted; accordingly, insert the following:

[73] Assignee: Scott Paper Company
Philadelphia, Pennsylvania

Column 4, line 4, change "disclosed" to --discloses--.
Column 5, line 32, change "regaining" to --regained--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*